US005982226A

United States Patent [19]

Rincon-Mora

[11] Patent Number: 5,982,226

[45] Date of Patent: Nov. 9, 1999

[54] OPTIMIZED FREQUENCY SHAPING CIRCUIT TOPOLOGIES FOR LDOS

[75] Inventor: Gabriel A. Rincon-Mora, Allen, Tex.

[73] Assignee: Texas Instruments Incorporated, Dallas, Tex.

[21] Appl. No.: 09/056,568

[22] Filed: Apr. 7, 1998

Related U.S. Application Data

[60] Provisional application No. 60/042,751, Apr. 7, 1997.

[51] Int. Cl.[6] ..... G05F 1/44; G05F 3/16

[52] U.S. Cl. ..... 327/541; 327/543; 323/273; 323/280

[58] Field of Search ..... 323/273, 280; 327/540, 541, 543, 538, 552; 330/107, 109

[56] References Cited

U.S. PATENT DOCUMENTS

| | | | |
|---|---|---|---|
| 5,412,309 | 5/1995 | Ueunten | 323/316 |
| 5,490,005 | 2/1996 | Boylan et al. | 323/285 |
| 5,563,501 | 10/1996 | Chan | 323/282 |
| 5,631,598 | 5/1997 | Miranda et al. | 327/540 |
| 5,682,093 | 10/1997 | Kivela | 323/273 |
| 5,686,820 | 11/1997 | Riggio, Jr. | 323/272 |
| 5,850,139 | 12/1998 | Edwards | 323/280 |
| 5,864,227 | 1/1999 | Borden et al. | 323/280 |
| 5,867,015 | 2/1999 | Corsi et al. | 323/316 |
| 5,909,109 | 6/1999 | Phillips | 323/280 |

*Primary Examiner*—Timothy P. Callahan
*Assistant Examiner*—Terry L Englund
*Attorney, Agent, or Firm*—W. James Brady, III; Richard L. Donaldson

[57] ABSTRACT

A low drop-out regulator 16 includes an error amplifier 18 having a first input for receiving a reference voltage Vref, a second input, and an output, a pass element 22 having a control terminal coupled to the output of the error amplifier and a current path coupled between an input voltage Vin and an output terminal Vout, and a pair of resistors 24, 26 coupled in series between the output terminal Vout and ground. The second input of the error amplifier 18 coupled to a node B between the pair of resistors. The error amplifier provides an added pole/zero pair in the frequency response of the regulator.

4 Claims, 4 Drawing Sheets

OPTIMIZED FREQUENCY SHAPING CIRCUIT TOPOLOGIES FOR LDOS

This application claims priority under 35 USC § 119(e) (1) of provisional application number 60/042,751 filed Apr. 7, 1997.

FIELD OF THE INVENTION

The invention relates generally to electronic systems and, more particularly, to a low drop-out regulator.

BACKGROUND OF THE INVENTION

An increasing number of low voltage applications require the use of low drop-out regulators or LDOs, i.e., cellular phones, pagers, laptops, camera recorders, etc. Typical LDO circuit architectures suffer from an inherent load regulation performance limitation. This limitation manifests itself through limited dc open-loop gain and results from stringent closed-loop bandwidth requirements. The limited dc open-loop gain and load regulation performance translate to restricted overall accuracy and/or more stringent requirements on the other specification parameters of the regulator. Mitigating this restriction is especially important for portable battery operated products, a growing market demand sector. These applications require low voltage operation as well as low quiescent current flow to maximize the efficiency and the longevity of single low voltage battery cells. Simultaneously, the demands on regulators become more strict because of consequential reductions in dynamic range. Low voltage and low quiescent current flow operation, unfortunately, tend to degrade the overall performance of power supply circuits. As a result, accuracy is adversely affected thereby requiring improvement.

SUMMARY OF THE INVENTION

A regulator includes an error amplifier having a first input for receiving a reference voltage, a second input, and an output; a pass element having a control terminal coupled to the output of the error amplifier and a current path coupled between an input voltage and an output terminal; a pair of resistors coupled in series between the output terminal and ground, the second input of the error amplifier coupled to a first node between the pair of resistors; and a load coupled to said output terminal between said pass element and said pair of resistors. The regular has an open loop frequency response including a first pole at a first frequency, a second pole at a second frequency greater than the first frequency, a first zero at a third frequency greater than the second frequency, a third pole at a forth frequency greater than the third frequency, a second zero at a fifth frequency greater than the fourth frequency, and a fourth pole at a sixth frequency greater than the fifth frequency. The error amplifier provides the second pole and the second zero in the open loop frequency response of the regulator to improve the open loop gain of the regulator.

DETAILED DESCRIPTION OF THE INVENTION

Figure 1:
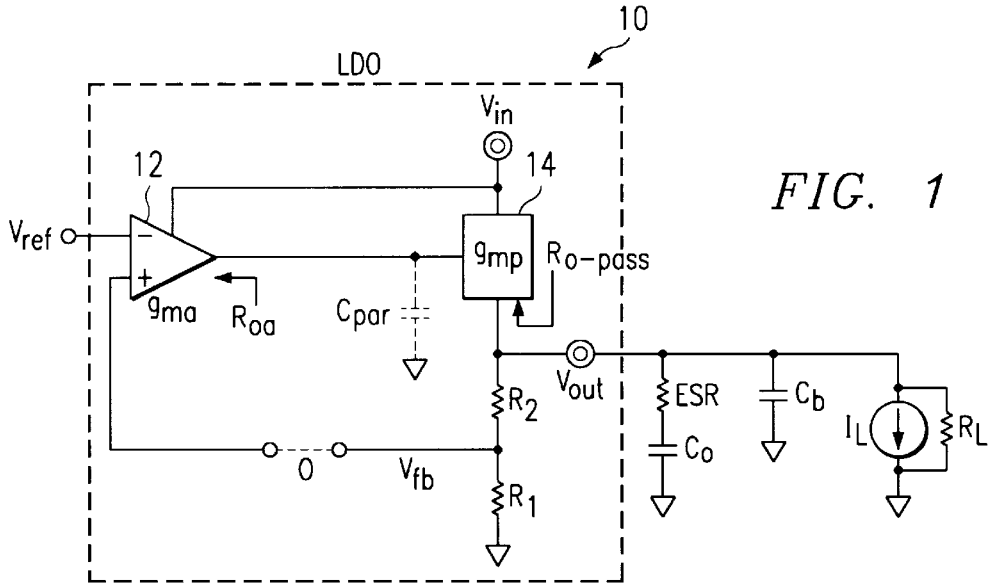
FIG. 1 shows a linear regulator and associated load.

FIG. 1 illustrates the basic components of a linear regulator and its associated load. The regulator 10 is composed of an error amplifier 12, a pass element 14, which may be a PMOS device, for example, and feedback resistors R1 and R2. An output load-current IL and associated output impedance RL, an output capacitor Co and associated electrical series resistance ESR, and bypass capacitors Cb constitute the load of the system. The ESR of the bypass capacitors is typically neglected because they are usually high frequency capacitors; in other words, they have low ESR values. The pass device is modeled as a circuit element exhibiting a transconductance of $g_{mp}$ and an output impedance of $R_{o\text{-}pass}$. The dashed line denoted by "O" is an electrical short during normal operation. However, it is an open circuit for the purpose of ac analysis.

The open-loop system of FIG. 1 must be unity gain stable, considering $V_{ref}$ and $V_{fb}$ to be the input and the output voltages respectively (open circuit at "O"). The open-loop frequency response of the system is characterized by three poles and one zero, a potentially unstable system. For the majority of the load-current range, the poles and the zero can be approximated to be the following:

$$P_1 \approx 1/2\pi R_{o\text{-}pass} C_o, \tag{1}$$

$$P_2 \approx 1/2\pi R_{es} C_b, \tag{2}$$

$$P_3 \approx 1/2\pi R_{oa} C_{par}, \tag{3}$$

and $$Z_1 \approx 1/2\pi R_{es} C_o. \tag{4}$$

Figure 2:
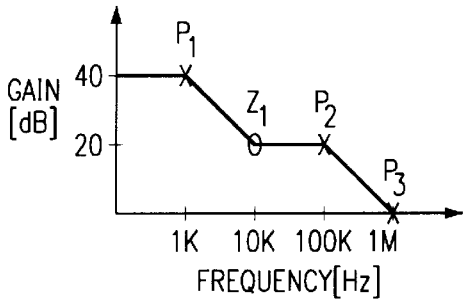
FIG. 2 is a graph showing the frequency response of the regulator of FIG. 1 under loading conditions.

FIG. 2 illustrates the frequency response of the regulator of FIG. 1 assuming that the output capacitor ($C_o$) is larger than the bypass capacitors ($C_b$).

Load regulation performance (output resistance of the regulator, $R_o$) is a function of the open-loop gain ($A_{ol}$) of the system and can be expressed as $$R_o = \frac{\Delta V_{LDR}}{\Delta I_o} = \frac{R_{o-pass}}{1 + A_{ol}\beta}, \tag{5}$$

where $\Delta V_{LDR}$ is the output voltage variation arising from a load-current variation of $\Delta I_o$, $R_{o\text{-}pass}$ is the output resistance of the pass device, and $\beta$ is the feedback factor. Consequently, the regulator yields better load regulation performance as the open-loop gain increases. However, the gain is limited by the closed-loop bandwidth of the system, equivalent to the open-loop unity gain frequency (UGF). The minimum UGF is bounded by the response time required by the system during transient load-current variations. Furthermore, the UGF is also bounded at the high frequency end by the parasitic poles of the system, i.e., the internal poles of the amplifier and pole $P_3$. If these parasitic poles are assumed to be located at higher frequencies than 1 MHz, then the gain at 1.0 kHz has to be less than approximately 40–45 dB depending on the location of $Z_1$ and $P_2$, as shown in FIG. 2. Moving the parasitic poles to higher frequencies is difficult because of the low quiescent current flow restriction (arising from battery operated products) and because of the inherently large size of the pass device (necessary for high output current capabilities). As a result, load regulation is limited by the constrained open-loop gain of the system. Simulations verified the above behavior of the frequency response.

Figure 3:
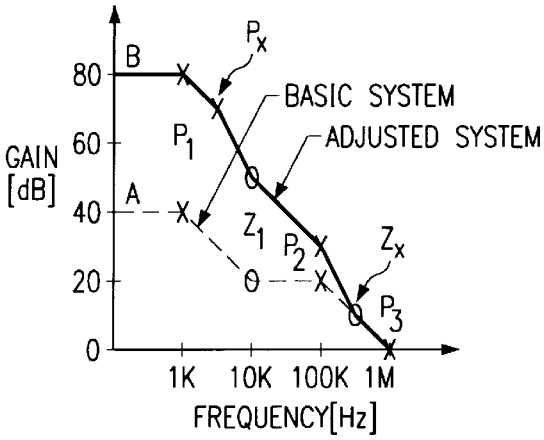
FIG. 3 is a graph showing augmented dc open-loop gain resulting from adding a pole/zero.

In accordance with one aspect of the invention, the dc open-loop gain of the system can be augmented, however, by adding a pole/zero pair as shown in FIG. 3. For a given unity gain frequency (UGF), the upper limit of the open-loop gain can be increased by manipulating the frequency response as depicted by trace B of the Figure. As seen in FIG. 3, the gain drops quickly as the frequency increases so that a larger dc gain is possible. Hence, regulation is improved while keeping the UGF away from parasitic poles. The placement of the extra pole and zero must take into account that $P_1$, $P_2$, and $Z_1$ are functions of the output capacitance, the electrical series resistance (ESR) of the output capacitor, and the load-current. However, the fact that $P_2$ and $Z_1$ track each other (both are inversely proportional to $R_{esr}$) can be used to optimize the design. It is further noted that the phase shift must be kept below 180° at frequencies equal to and lower than the UGF to maintain stability, as dictated by Nyquist criterion.

The design location of the additional pole and zero depends on the gain of the system and the variability of $Z_1$ and $P_2$. The achievement of maximum gain comes at the expense of restricted ESR range. This range is important for its variation is dependent on the type of capacitor and the fabrication process. Typically, relatively inexpensive capacitors exhibit the worst ESR variation. Given a constant UGF, maximum gain occurs when $P_x$ and $Z_x$ are maximally displaced from each other in frequency. This is because the drop in gain per decade of frequency in mid-band is larger when $P_x$ is at lower frequencies and $Z_x$ is at higher frequencies. Thus, maximum gain can be achieved efficiently if $Z_1$ and $P_2$ are guaranteed to be between $P_x$ and $Z_x$ throughout their entire range. For this to be true, the ESR must be greater than some finite non-zero number. However, $Z_1$ and $P_2$ tend to infinity as the ESR is allowed to approach zero. Consequently, the frequency differential between $P_x$ and $Z_x$ is limited by the phase requirements of the system, less than 180° phase shift. If the ESR is bounded by a finite lower limit where $Z_x$ is guaranteed to be greater than $Z_1$, the phase minimum is defined by $P_x$ and $Z_1$, otherwise defined by $P_x$ and $Z_x$.

A regulator circuit architecture in accordance with the invention provides a new function, namely, adding a pole/zero pair in the frequency response of the open-loop system. This goal is achieved by incorporating it into the frequency response of the error amplifier by way of active components. The amplifier thus serves to shape the frequency behavior of the system as well as provide gain.

Figure 4A:
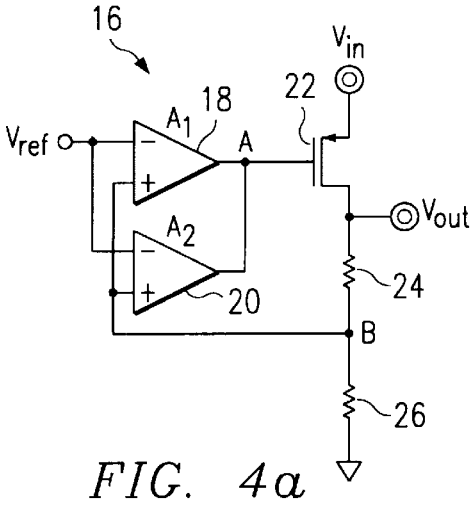
FIG. 4*a* shows a parallel amplifier circuit for generating a pole/zero pair.
Figure 4B:
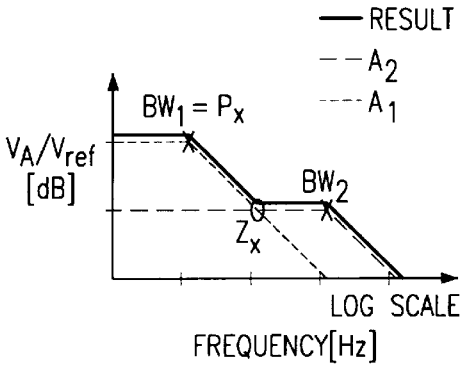
FIG. 4*b* shows the frequency response of amplifiers 18 and 20 of FIG. 4*a*.
Figure 5:
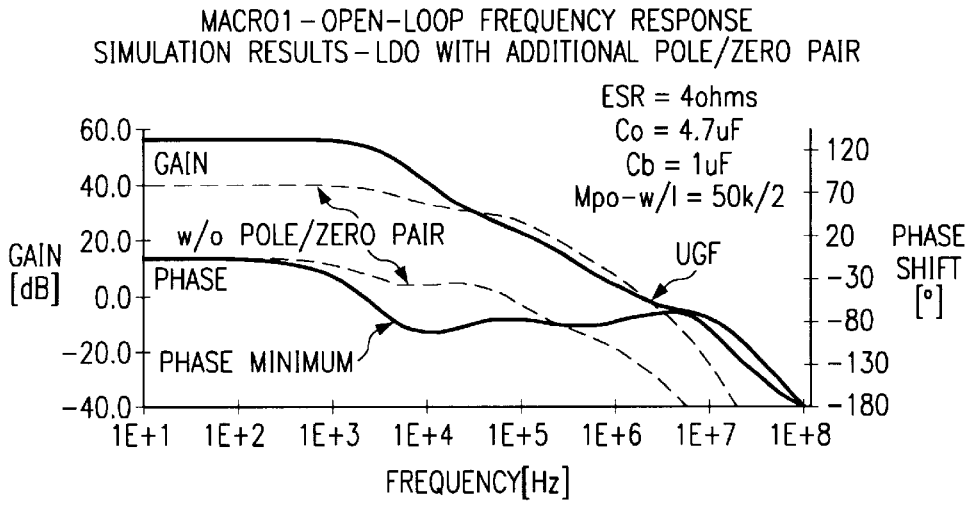
FIG. 5 is a graph showing the frequency response of an LDO using the circuit of FIG. 4*a*.

In one embodiment of the invention, the integration of the pole/zero pair response into the amplifier is achieved by having dual amplifiers connected in parallel as shown by regulator 16 in FIG. 4*a*. Amplifiers 18 and 20 are connected in parallel with inverting inputs coupled to Vref and outputs coupled to node A. PMOS transistor 22 has a gate coupled to node A and a source-drain path coupled between Vin and Vout. Resistors 24 and 26 are coupled in series between Vout and ground. The non-inverting inputs of amplifiers 18 and 20 are coupled to node B between resistors 24 and 26. Amplifier 18 has high gain and its bandwidth determines the location of $P_x$ while amplifier 20 has lower gain (whose magnitude determines the location of $Z_x$) and higher bandwidth. The output impedances of both amplifiers need to be relatively low for proper operation. The regulator 16 operates by feed-forwarding the ac signal through a bypass path constituted by the amplifier 20 with lower gain. The transfer function of both amplifiers and the resulting response of the system are shown in FIG. 4(*b*). The gain-bandwidth product of the high gain amplifier can be utilized to determine the necessary gain of the other amplifier to introduce $Z_x$ at the desired frequency, as shown by the following relation, $$GBW_1 = \frac{A_1}{2\pi P_x} = \frac{A_2}{2\pi Z_x} \text{ or } \frac{A_1}{A_2} = \frac{P_x}{Z_x}, \tag{6}$$

where $A_1$ and $A_2$ correspond to the gain of amplifiers one and two respectively while $GBW_1$ corresponds to the gain-bandwidth product of amplifier one. It is observed that the bandwidth of the second amplifier constitutes a parasitic pole in the overall system. Furthermore, the frequency of $P_x$ is dependent on the dominant pole of amplifier one, which is subject to process variations. However, the ratio of $P_x$ and $Z_x$ exhibits less variation since it is mainly determined by component matching issues, if designed carefully. FIG. 5 shows the simulation results of a macro-model circuit implementing the parallel amplifier structure. There is roughly a 17 dB improvement in the dc open-loop gain of the system with the additional pole/zero pair for a given unity gain frequency (UGF). Load regulation performance improved from 41 to 12 mV/100 mA, corresponding to a 71 % reduction.

Figure 6A:
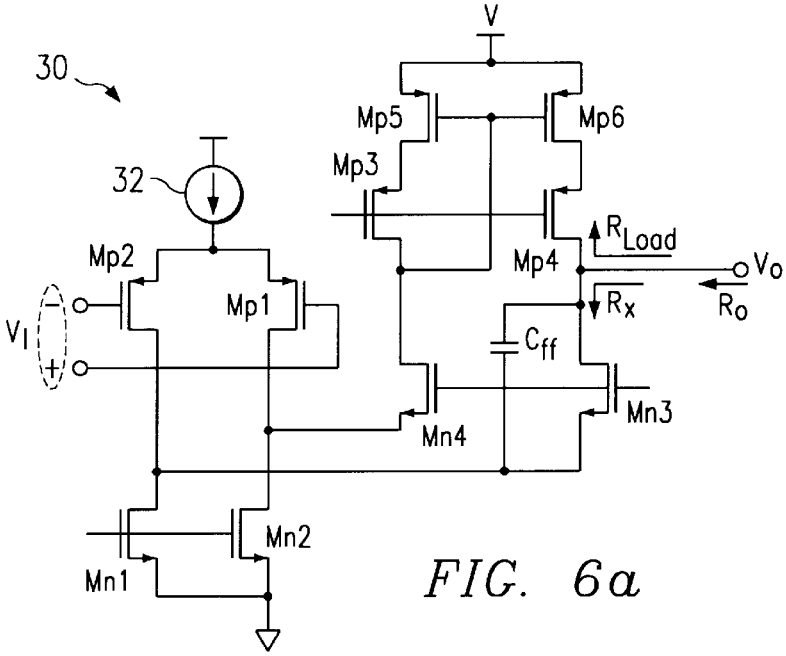
FIG. 6*a* shows a circuit having a feed-forward capacitor in a folded topology for generating a pole/zero pair.
Figure 6B:
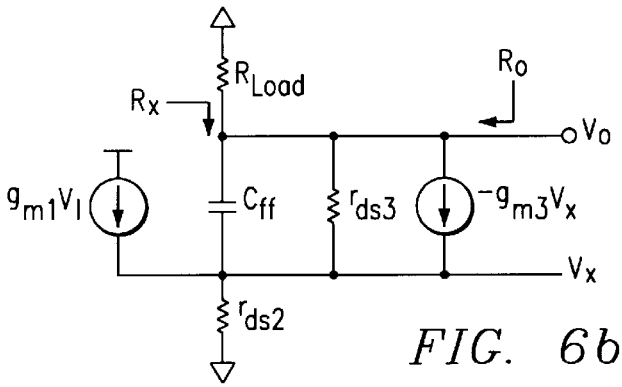
FIG. 6*b* is a small signal model of the circuit of FIG. 6*a*.

In another embodiment of the invention, a pole/zero pair can also be generated through the use of a feed-forward capacitor in a folded topology frequency shaping error amplifier 30 as shown in FIG. 6(*a*). Amplifier 30 includes NMOS transistors Mn1–Mn4, PMOS transistors Mp1–Mp6, current source 32, and feed-forward capacitor Cff. At low frequencies, the amplifier is unaffected by the feed-forward capacitor ($C_{ff}$). Thus, the gain is that of a typical folded topology, which is characteristically high. At high frequencies, the capacitor acts like an electrical short giving rise to the gain of a non-cascoded architecture (lower gain). The corresponding small signal model of the circuit is represented in FIG. 6(*b*). The gain of the amplifier ($A_v$) is described by $$A_v \approx g_{m1} R_o = g_{m1}[R_{Load} \| R_x] \approx g_{m1} R_x, \tag{7}$$

where $g_{m1}$ is the transconductance of Mp1, $R_{Load}$ is the output resistance of the mirror load, and $R_x$ is $$R_x = \frac{r_{ds3}[1 + g_{m3} r_{ds2}]}{1 + s r_{ds3} C_{ff}} + r_{ds2} = \frac{\left\langle s + \frac{r_{ds2} + r_{ds3}[1 + g_{m3} r_{ds2}]}{r_{ds3} r_{ds2} C_{ff}} \right\rangle r_{ds2}}{s + \frac{1}{r_{ds3} C_{ff}}}, \tag{8}$$

where $g_{m3}$ is the transconductance of Mn3 and $r_{ds2}$ [$r_{ds3}$] is the output resistance of transistor Mn2 [Mn3].

Figure 7:
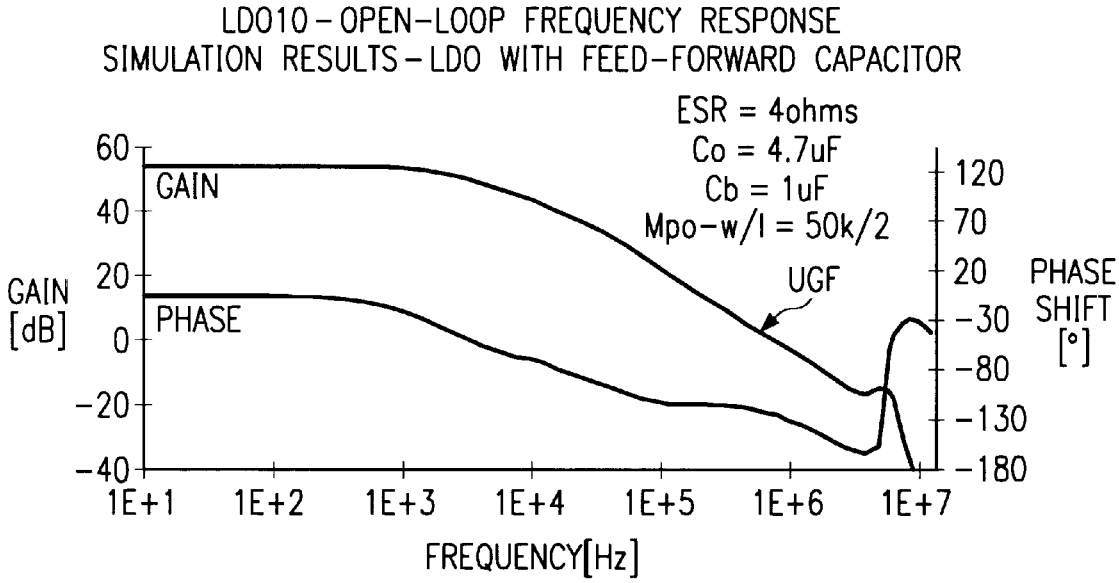
FIG. 7 is a graph showing the frequency response of an LDO using the circuit of FIG. 6*a*.

Consequently, the locations of the pole and the zero are $$Z_x \approx \frac{g_{m3}}{2\pi C_{ff}} \tag{9}$$

and $$P_x \approx \frac{1}{2\pi r_{ds3} C_{ff}}, \tag{10}$$

where $g_{m3}$ and $r_{ds3}$ correspond to the transconductance and the output resistance of Mn3. The cascoding element's transconductance ($g_{m3}$) needs to be small, which implies the use of MOS devices instead of bipolar transistors in a biCMOS environment. FIG. 7 illustrates the simulated frequency response of LDO 10 when using the error amplifier 30 of FIG. 6(*a*) in place of amplifier 12. It is noted that the dc open-loop gain is a function of load-current because the open-loop output impedance of the regulator is dominated by the early voltage of the power PMOS transistor. As a result, the output resistance of the pass device is larger ($R_{o\text{-}pass}$ $1/I_{Load}$) and therefore the gain is higher at lower output currents.

Figure 8A:
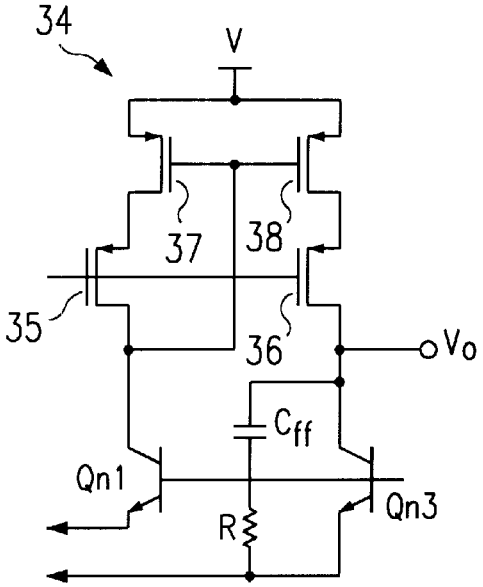
FIGS. 8*a* and 8*b* show variations of a frequency shaping amplifier.
Figure 8B:
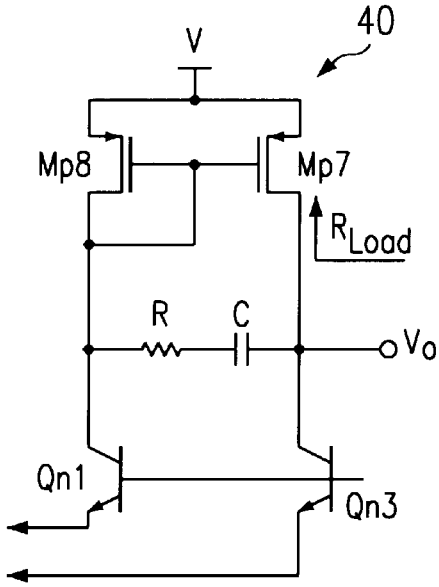

The frequency shaping amplifier can also take other forms within the same folded architecture, as is illustrated by the different loading structures in FIGS. 8*a* and 8*b*. A variation of the feed-forward concept is embodied in frequency shaping amplifier circuit 34 of FIG. 8(*a*). Frequency shaping amplifier circuit 34 includes PMOS transistors 35–38, NPN transistors Qn1 and Qn3, and series connected resistor R and feed-forward capacitor Cff. Small signal analysis shows that the pole and the zero locations for this structure are described by $$Z_x \approx \frac{1}{2\pi R C_{ff}} \tag{11}$$

and $$P_x \approx \frac{1}{2\pi[R + r_{o3}]C_{ff}}, \tag{12}$$

where $r_{o3}$ is the output resistance of Qn3.

Another embodiment of a frequency shaping amplifier providing the pole/zero pair is illustrated in FIG. 8(*b*). Frequency shaping amplifier 40 in FIG. 8*b* includes PMOS transistors Mp7 and Mp8, NPN transistors Qn1 and Qn3, and series connected resistor R and capacitor C. This circuit takes advantage of the input and the output impedance of the mirror load, composed of Mp7 and Mp8, to help shape and define the frequency response of the amplifier. The corresponding pole and zero locations are described by $$Z_x = \frac{1}{2\pi\left(R + \frac{1}{g_{m8}}\right)C} \tag{13}$$

and $$P_x = \frac{1}{2\pi\left(R + \frac{1}{g_{m8}} + r_{ds7}\right)C}, \tag{14}$$

where $g_{m8}$ is the transconductance of Mp8 and $r_{ds7}$ is the output resistance of Mp7. The frequency response behavior simulated results that closely resemble those illustrated in FIGS. 5 and 7.

The frequency response of these amplifiers introduces a single parasitic pole to the overall system. This parasitic pole is formed by the loading capacitor of the amplifier. This may be significantly large if the amplifier drives the gate of the large power PMOS transistor directly, pass device in the linear regulator structure. The severity of this problem can be alleviated by buffering the output of the amplifier and thus isolating the large capacitive load from the amplifier. The effects of process variations on performance manifest themselves through deviations in transconductances and transistor output impedances, which in turn define the locations of the pole and the zero as well as the parasitic pole.

Figure 9:
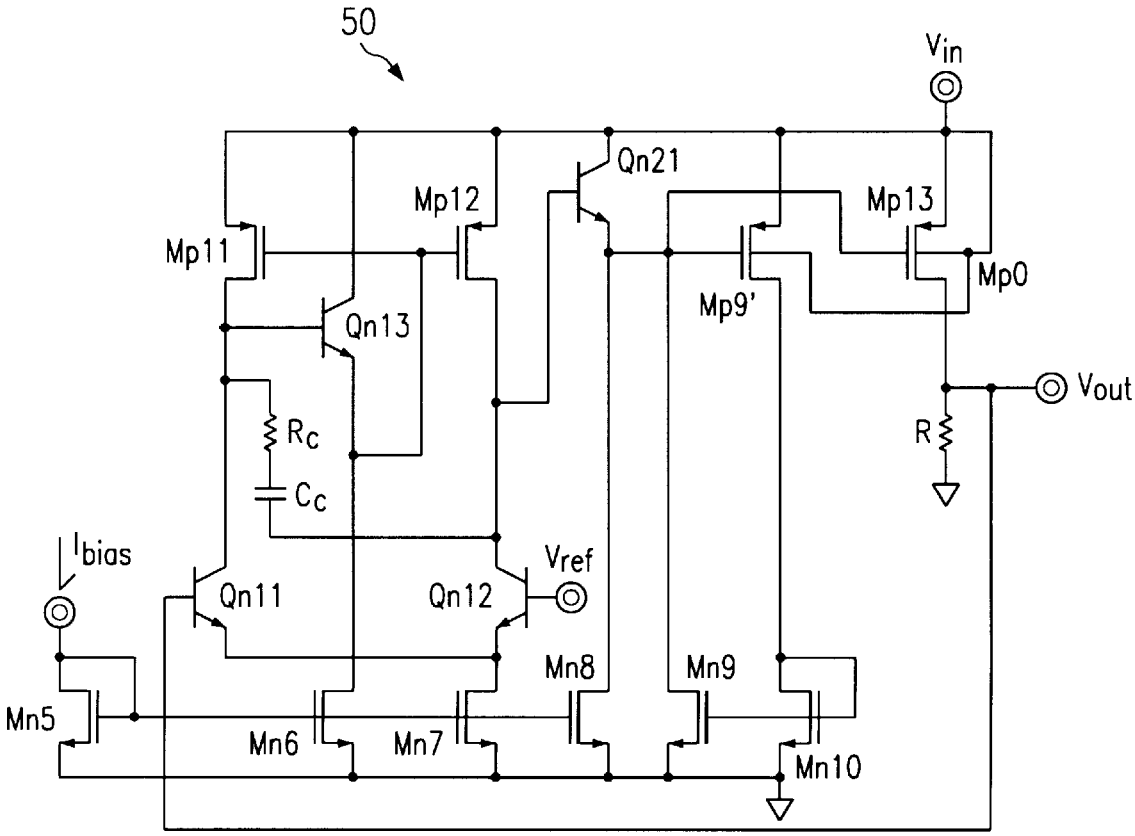
FIG. 9 shows a low drop-out regulator using a frequency shaping amplifier in accordance with the invention.

A low drop-out regulator using a frequency shaping amplifier was fabricated in MOSIS 2 μm CMOS process with a p-base layer and is illustrated in FIG. 9. The topology uses a single stage low voltage amplifier with a pole/zero generation structure similar to that of FIG. 8(*b*). LDO 50 of FIG. 9 includes NMOS transistors Mn5–Mn10, PMOS transistors Mp9, Mp11–Mp13, NPN transistors Qn11–Qn13, Qn21, resistors R and Rc, and capacitor Cc. Transistors Qn11–Qn13, Mp11 and Mp12 form the frequency shaping error amplifier. This amplifier differs from that in FIG. 8*b* in that transistor Qn13 is added to the mirror formed by Mp11 and Mp12 to provide a low voltage current mirror with level shifting. Transistors Qn21, Mp9, and Mn8–Mp10 form a current efficient buffer circuit. Transistor Mpo is the output PMOS transistor. The load of the differential pair Qn11, Qn12 is the level shifted current mirror Mp11, Mp12, Qn13.

Figure 10:
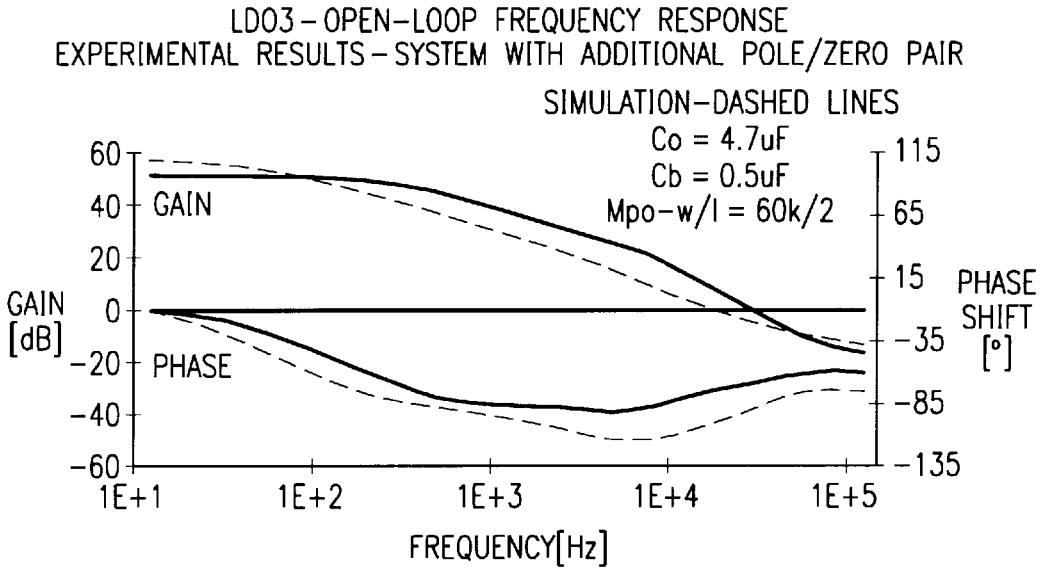
FIG. 10 is a graph showing the frequency response of the circuit of FIG. 9.

The current efficient buffer circuit Mp9, and Mn8–Mn10 is used to isolate the high gate capacitance of the power PMOS device (Mpo) from the gain stage. The corresponding frequency response is shown in FIG. 10. The ac performance follows the behavior predicted by analysis; in other words, the gain drops at rates of either 20 or 40 dB per decade of frequency (for frequencies higher than the dominant pole) while maintaining phase margin. In particular, stability was maintained for various combinations of bypass capacitors (0.1 to 2.2 μF), electrical series resistance ($0<ESR\leqq 12+\Omega$), and load-current (0 to 50 mA). As a result of these various loading conditions, the frequency response experiences a medley of different curves that fall within the parameters specified by the complex system of poles and zeros analyzed.

Enhancing regulator performance is especially important when considering that the demand for mobile battery operated products is increasing. Such applications entail low voltage and low quiescent current flow characteristics. As a result, specifications become more stringent in a reduced dynamic range environment while, unfortunately, maintaining innate circuit performance limitations. One major limitation to accuracy, in particular, is load regulation. This arises because of the frequency response requirements of the closed-loop bandwidth, equivalent to the unity gain frequency. The bandwidth is constrained by the transient requirements and the location of the parasitic poles of the system. As a result, open-loop gain and therefore load regulation performance is limited. The invention provides circuit topologies to improve this performance parameter. These circuits are also appropriate for a low voltage environment. The system implementing the pole/zero pair simulated to have an improvement in dc open-loop gain of approximately 17 dB and a load regulation performance improvement of roughly 71%.

What is claimed is:

1. A regulator, comprising:

an error amplifier having a first input for receiving a reference voltage, a second input, and an output;

a pass element having a control terminal coupled to said output of said error amplifier and a current path coupled between an input voltage and an output terminal;

a pair of resistors coupled in series between said output terminal and ground, said second input of said error amplifier coupled to a first node between said pair of resistors;

a load coupled to said output terminal between said pass element and said pair of resistors;

said regulator having an open loop frequency response including a first pole at a first frequency, a second pole at a second frequency greater than said first frequency, a first zero at a third frequency greater than said second frequency a third pole at a fourth frequency greater than said third frequency, a second zero at a fifth frequency greater than said fourth freguency, and a fourth pole at a sixth frequency greater than said fifth frequency;

said error amplifier providing the second zero in the open loop frequency response of the regulator.

2. The regulator of claim 1, in which said error amplifier includes a first amplifier and a second amplifier coupled in parallel with said first amplifier.

3. The regulator of claim 2, in which each of said first and second amplifiers has an inverting input for receiving said reference voltage and a non-inverting input coupled to said first node between said pair of resistors.

4. The regulator of claim 1, in which said error amplifier includes a feed forward capacitor for determining the location of the second frequency and the fifth frequency.

* * * * *